US011369234B2

(12) United States Patent
Mason

(10) Patent No.: US 11,369,234 B2
(45) Date of Patent: Jun. 28, 2022

(54) SHOWER CURTAIN CONTAINMENT APPARATUS

(71) Applicant: Charles Albert Mason, Golden, CO (US)

(72) Inventor: Charles Albert Mason, Golden, CO (US)

( * ) Notice: Subject to any disclaimer, the term of this patent is extended or adjusted under 35 U.S.C. 154(b) by 0 days.

(21) Appl. No.: 17/369,674

(22) Filed: Jul. 7, 2021

(65) Prior Publication Data

US 2021/0330135 A1 Oct. 28, 2021

Related U.S. Application Data

(63) Continuation of application No. 14/617,479, filed on Feb. 9, 2015, now Pat. No. 11,083,345.

(60) Provisional application No. 61/965,766, filed on Feb. 7, 2014.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/608, 558
See application file for complete search history.

(56) References Cited

U.S. PATENT DOCUMENTS 2,120,155 A * 6/1938 Shera ..... A47K 3/38 4/608
2,173,993 A 9/1939 Amdur
3,382,507 A 5/1968 Micheau
4,088,174 A 5/1978 Edwards
4,723,326 A * 2/1988 Tarlow ..... A47K 3/38 160/349.1
5,007,120 A 4/1991 Annand
5,097,541 A 3/1992 Annand
5,228,149 A 7/1993 Phinn, Jr.
5,421,393 A * 6/1995 Wolfe ..... A47K 3/38 4/558
6,041,454 A 3/2000 Summerford
6,996,862 B1 2/2006 Shippy et al.
10,555,644 B2 2/2020 Johnson
11,141,025 B2 10/2021 Johnson et al.
(Continued)

FOREIGN PATENT DOCUMENTS

WO 1993004620 A1 3/1993

*Primary Examiner* — Christine J Skubinna
(74) *Attorney, Agent, or Firm* — Dunlap Bennett & Ludwig PLLC

(57) ABSTRACT

Shower curtains and shower curtain liners routinely get sucked into the occupant of a showering space due to the "shower-curtain effect," which is the phenomenon in which a shower curtain or shower curtain liner gets drawn inward with a running shower. The present invention counteracts the shower curtain effect. In certain an embodiments of the invention, an outside unit and inside unit incorporate attachment mechanisms to draw both units into each other while trapping the shower curtain between both units. Attached to the outside unit of certain embodiments of the invention is a connector that also attaches a bottom unit. The bottom unit of certain embodiments of the present invention incorporates weight sufficient to utilize gravity to pull the attached shower curtain downward. The bottom unit places pressure on the external side of a bathtub to additionally force the entire apparatus and shower curtain outward.

8 Claims, 5 Drawing Sheets

(56) References Cited

U.S. PATENT DOCUMENTS

| | | | | |
|---|---|---|---|---|
| 2006/0085904 | A1 | 4/2006 | Tsvok | |
| 2012/0227179 | A1 * | 9/2012 | Beyda | A47K 3/302<br>4/608 |

* cited by examiner

SHOWER CURTAIN CONTAINMENT APPARATUS

CROSS-REFERENCE TO RELATED APPLICATIONS

This application claims the benefit of and is a continuation of U.S. application Ser. No. 14/617,479, filed on Feb. 9, 2015, which is hereby expressly incorporated by reference in its entirety for all purposes.

The co-pending U.S. application Ser. No. 14/617,479 further claims the benefit of and is a non-provisional of a provisional U.S. Application Ser. No. 61/965,766, filed on Feb. 7, 2014, which is hereby expressly incorporated by reference in its entirety for all purposes.

A portion of the disclosure of this patent document contains material, which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

TECHNICAL FIELD

Shower curtains and shower curtain liners routinely get sucked into the occupant of a showering space due to the "shower-curtain effect," which is the phenomenon in which a shower curtain or shower curtain liner gets drawn inward with a running shower. The present invention counteracts the shower curtain effect. In certain an embodiments of the invention, an outside unit and inside unit incorporate attachment mechanisms to draw both units into each other while trapping the shower curtain between both units. Attached to the outside unit of certain embodiments of the invention is a connector that also attaches a bottom unit. The bottom unit of certain embodiments of the present invention incorporates weight sufficient to utilize gravity to pull the attached shower curtain downward. The bottom unit places pressure on the external side of a bathtub to additionally force the entire apparatus and shower curtain outward.

BACKGROUND

Shower curtains and shower curtain liners routinely get sucked into the occupant of a showering space due to the "shower-curtain effect," which is the phenomenon in which a barrier, such as a shower curtain or shower curtain liner gets drawn inward with a running shower. This effect reduces the effective showering space available to the occupant of the shower. As a result, a moldy or dirty shower curtain liner may rub against the shower occupant's skin. Similar problems have been observed in other instances where a barrier separates from an exterior, on one or more sides, a space containing a fluid motion, such as the flow of a liquid or gas, such as for example only, water subjected to a gravitational force. Previous mechanisms to hold a barrier, such as a shower curtain or shower curtain liner, in a certain configuration have helped somewhat, but these known inventions include significant drawbacks.

SUMMARY

At the heart of the present invention is using force, when applied in a specific manner to a barrier that partially or fully encloses space affected by the shower curtain effect, can solve the shower curtain effect without the drawbacks associated with items known in the prior art. A barrier as used herein can include a shower curtain or shower curtain liner. Other embodiments could include different barriers and are not limited to shower curtains or shower curtain liners.

In accordance with the present invention, a barrier is affixed with an object or objects oriented in a configuration to apply the force required to prevent the shower curtain effect and its associated problems. In accordance with the present invention, the forces applied to the barrier meet or exceed the forces caused by the shower curtain effect. In certain embodiments of the invention, the force applied on the barrier harnesses and/or otherwise derives from the rigidity of a body located near the bottom of the barrier, such as the exterior edge of a bathtub. In such embodiments of the invention, an apparatus protrudes downward and/or outward from an external unit to apply pressure to the exterior edge of a bathtub. The resistance force of the exterior edge of the bathtub keeps the barrier to the outer edge of the tub, effectively counteracting the inward forces caused by the shower curtain effect.

The problems associated with the shower curtain effect include many examples including but not limited to the examples described in this paragraph. For instance, to counteract the shower curtain effect, a shower user may place a weighted object such as a shampoo bottle on top of a shower curtain resting on the top of a bathtub. This scenario creates water accumulation and the development of puddles adjacent to or near the barrier separating the shower area from the exterior area of the bathtub. This scenario presents the added risk of spillage of water over to the exterior area of the bathtub. In certain embodiments of the invention, the barrier separating the shower area from the exterior area is maintained in a configuration to cause water to flow to the interior area of the bathtub without accumulating into puddles adjacent to the barrier or in the exterior area of the bathtub. Another problem associated with the shower curtain effect is reduction of the shower area space because the associated forces push or pull the barrier inward. Certain embodiments of the present invention solve the reduction of shower area space on the inside of the barrier, providing the occupant with full utilization of the full area of the shower space. Another problem associated with the shower curtain effect is that the internal side of a barrier, which typically becomes moldy or dirty due to the moisture associated with a shower, may come into contact with the skin of the shower user. In certain embodiments of the present invention, the barrier is forced outward to prevent a moldy or dirty barrier from encroaching into the shower space and touching the skin of the occupant.

The present invention demonstrates a number of advantages over other devices known in the prior art. Compared to the prior art, the design associated with certain embodiments of the invention has a minimum intrusion to the occupant of the shower/tub. Moreover, the present invention requires only a minimum of one unit to achieve its intended function, unlike the prior art. Further, the prior art addresses the challenges posed by the shower curtain effect in a different manner. For example, United States Patent Publication Number 2012/0227179, to Beyda ("Beyda") describes a large attachment to a shower curtain, such as a large flap sheet. Unlike Beyda, which due to its bulk and configuration causes difficulty to the user in attempting to close a shower curtain, the present invention allows easy closure of a barrier, due in part to its much smaller size and specific novel configuration.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the exemplary claim provided herein.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, and together with the detailed description, explain the principles of the system. No attempt is made to show structural details in more detail than is necessary for a fundamental understanding of the system and various ways in which it is practiced. The following figures of the drawing include.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered as exemplary only, with the true scope and spirit being indicated by the following claims.

At the heart of certain embodiments of the present invention is a mechanism that allows for the bottom of a barrier, such as a shower curtain or shower curtain liner to remain on the interior of the shower, bathtub, or containment area while guiding the shower curtain outward away from the occupant and/or the interior of the shower or tub area. Certain embodiments of the present invention utilize an apparatus that places forces on the barrier to allow for the greatest resistance to the forces accompanying the shower curtain effect.

Figure 1:
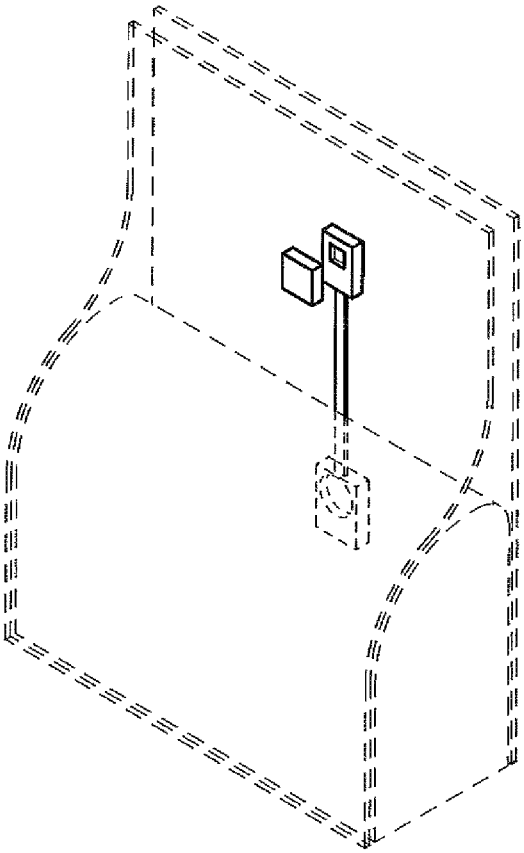
FIG. 1 View from a top-side angle of an embodiment of the invention.
Figure 2:
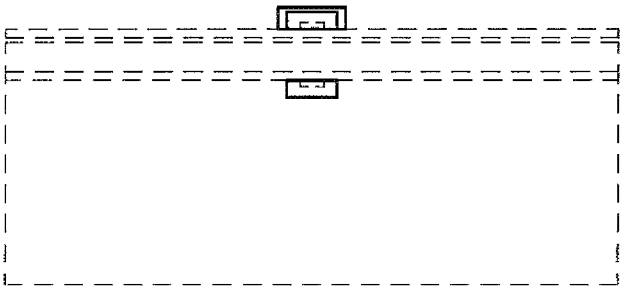
FIG. 2 Top-down view of an embodiment of the invention.
Figure 6:
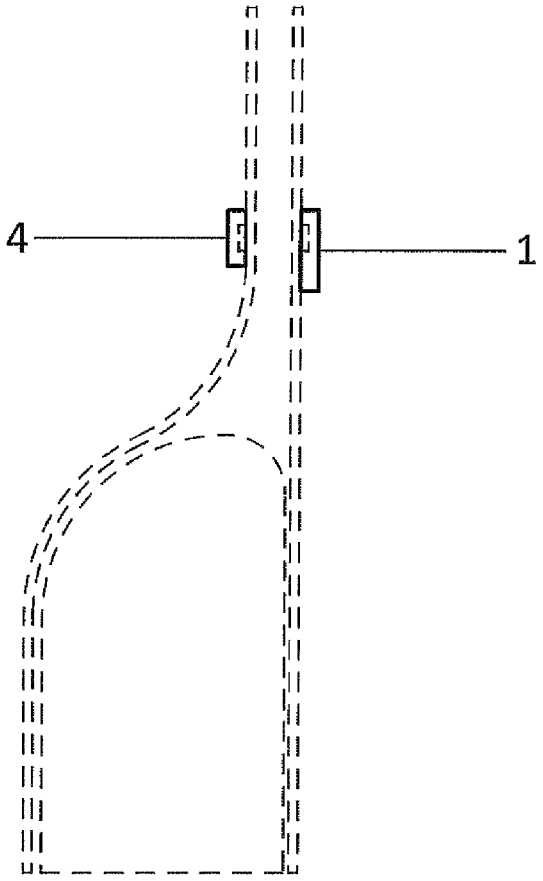
FIG. 6 Side view of an embodiment of the invention.

The present invention solves problems associated with the shower curtain effect. In certain embodiments of the present invention, the internal unit 4 traps one or more barriers between itself and an external unit 1 to support the apparatus comprising the embodiment of the invention via attachment to said barrier or barriers, while a bottom unit 2 located on the exterior of the barrier or barriers pulls downward and/or outward on the rest of the apparatus and/or barrier or barriers via a connective body 3 that connects the bottom unit 2 to the external unit 1. Certain embodiments of the present invention places forces on a barrier or barriers in such a manner to effectively counteract the shower curtain effect, as in the isometric view depicted in FIG. 1 and a lateral view depicted in FIG. 6. The compact configuration of such embodiment, as depicted in FIG. 2, allows for the easy movement of the barrier or barriers by the occupant of the enclosed space while the apparatus comprising such embodiment is attached to the barrier or barriers. In another embodiment of the invention, depicted by FIG. 7, an elongated rigid object affixed to a barrier or barriers replaces the connective body 3 and bottom unit 2, and directly or indirectly places force upon the exterior edge of a rigid body, such as a bathtub, located near the bottom of the barrier or barriers, to counteract the consequences of the shower curtain effect.

Figure 3:
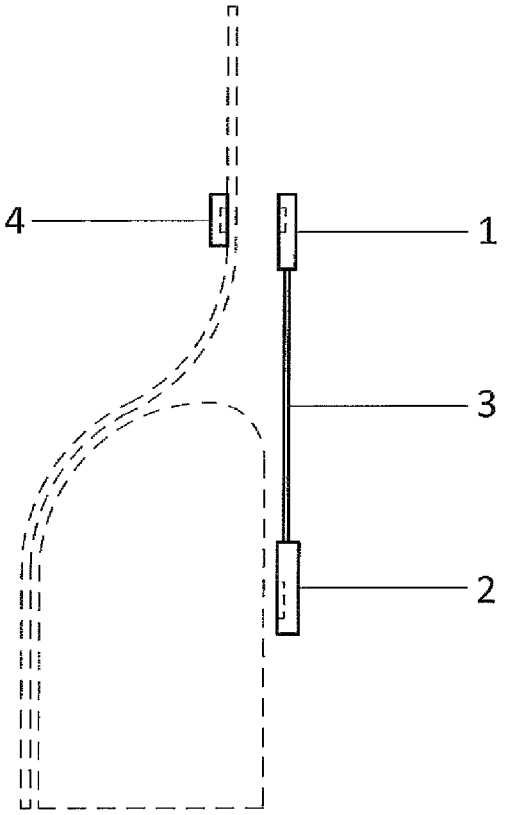
FIG. 3 Side view of an embodiment of the invention.

Certain embodiments of the invention, as depicted in FIG. 3, comprise an internal unit 4, an external unit 1, a connector unit 3, and a bottom unit 2. These portions of the certain embodiments of the invention utilize the gravitational forces harnessed by the bottom unit 2 to pull the exterior layer of a barrier downward and/or outward. In certain embodiments of the invention, the bottom unit 2 is connected to the external unit 1 by a connector unit 3. In embodiments of the invention, said connector unit 3 may feature a thin, lightweight, flexible or rigid apparatus. In certain embodiments of the invention, said connector unit 3 may feature, for example only, a plastic rod, an aluminum rod, a string, a cord, a cable, a chain, a rubber band, or a similar material as the primary element of the connector unit 3 apparatus. In other embodiments of the invention, internal unit 4 integrates within the barrier in a way so as to enable the direct affixation of external unit 1 or an alternative apparatus directly to the barrier via the integrated internal unit 4 or alternative apparatus. An example of such embodiment described in the preceding sentence may include for example only a snap woven directly into the barrier, a magnet sewn into the barrier, or Velcro incorporated into or glued onto the barrier directly.

Figure 4:
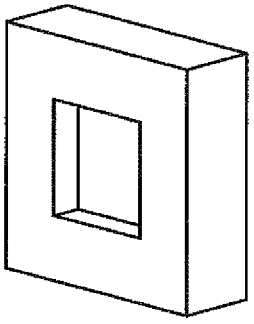
FIG. 4 Side angular view of an embodiment of the invention related to the affixation of the embodiment to a supporting body.
Figure 5:
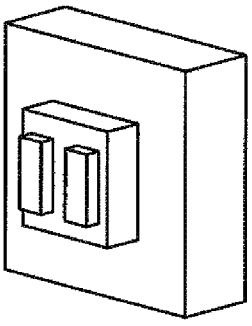
FIG. 5 Side angular view of an embodiment of the invention showing an alternative mechanism utilizing magnets to affix the embodiment to a supporting body.

In certain embodiments of the present invention, the external unit 1 connects to the internal unit 4 to affix to a barrier. In such embodiments of the invention, the affixation to the barrier may be accomplished via a male to female joining action, as in, for example only, a snap fastener, designed to trap a portion of the barrier between the internal unit 4 and the external unit 1. FIG. 4 depicts certain embodiments of the invention, where a female internal unit or external unit uses a snapping action. In another embodiment of the present invention, magnets are utilized to trap the barrier between the internal unit 4 and the external unit 1, as seen in FIG. 5. In certain embodiments of the invention, the inside unit 4 and/or external unit 1 may be textured to grip a shower curtain liner and prevent movement of the embodiment of the invention along said shower curtain liner. As those skilled in the art can appreciate, the affixation of the barrier may be accomplished by other means known in the art.

Other embodiments may rely on integration of either the attachment mechanism or the units themselves into a barrier such as a shower curtain to attach internal unit 4 and external unit 1. For example, one embodiment integrates a magnet into a shower curtain. In this embodiment, the magnet connects internal unit 4 and external unit 1. One appreciates that the exact attachment mechanism integrated into the shower curtain may not necessarily rely on magnets, but may instead incorporate snaps, Velcro, or other mechanism of attachment. In another embodiment, the connector unit 3 and/or bottom unit 2 is incorporated into the barrier itself, such as a shower curtain liner. In this embodiment, the connector unit 3 is integrated by way of molding during liner fabrication, but alternative embodiments may make use of other means of incorporation, such as sonic welding. Other embodiments also integrate the bottom unit 2 in the same manner.

In an embodiment of the invention, the external unit 1 and the internal unit 4 attach in proximity to the barrier at a point well above the crest of the water containing mechanism, such as a bathtub. In certain embodiments where the related apparatus affixes to a shower curtain or shower curtain liner, the height above the highest point (zero) of the bathtub to affix the external unit 1 and/or internal unit 4 to the barrier is approximately one half inch to twelve inches. In an embodiment of the invention, the external unit 1 and internal unit 4 may be connected to the barrier via any of a variety of connectors such as, for example only, magnets, snaps, Velcro, screws, glue, adhesive, or other means. Further to this, in embodiments of the invention, the internal unit 4, external unit 1, connector unit 3 and bottom unit 2 may take on any shape or form, and may contain electronics or other uses. Such items, which embodiments of the external unit 1, internal unit 4, and connector unit 3 and/or bottom unit 2 may incorporate, may include, light emitting diodes (LEDs), batteries, pictures, cartoons, sensors, speakers, or other items specifically included to display a color or colors. The combination of the shapes and forms but be combined into a singular shape or form, a combination thereof or multiple shapes and forms.

An embodiment of the invention may optionally include a connector unit 3.

Said connector unit 3 in such embodiment of the invention may take on or otherwise feature any or many of a variety of shapes or forms. In an embodiment of the invention, the connector unit may contain electronics or other items therein. Such items in such embodiment of the invention may include but are not limited to LEDs, batteries, pictures, sensors, speakers, or items specifically included to display a color or colors.

Other embodiments may incorporate additional ancillary features into internal unit 4, external unit 1, bottom unit 2, or all three, in order to provide further utility in addition to those stated here. These may include but are not limited to humidity and temperature sensing devices, Mercury sensors to detect movements or other forms of detection, such as body/object presence, sound or smoke. In addition to sensing features, these embodiments may also incorporate output elements, such as speakers, OLED displays, clocks, or LED lights. These embodiments may further incorporate batteries or other power sources to power these additional features, and appropriate wiring to distribute that power to any incorporated electrical devices that require it. Heavier additional features may be intentionally arranged in these embodiments in the bottom unit 2, such that the heavy elements themselves provide the weighting effect. These alternative features may be used in conjunction with one another in alternative embodiments.

An example of one of these embodiments may incorporate LED lights into the internal unit 4, which are used to illuminate the bathroom, and a speaker incorporated into the external unit 1, which is initiated by motion detection or built in clock. The electronic elements in this embodiment are powered by a AAA battery in the bottom unit 2, which provides power to the internal 4 and external 1 units via insulated copper wiring embedded in the connector unit 3. In this embodiment, the AAA battery itself provides power and acts as the weight. Another embodiment incorporates Bluetooth communication into one or more units, allowing the embodiment to notify a user when water temperature has reached a pre-designated value.

Figure 7:
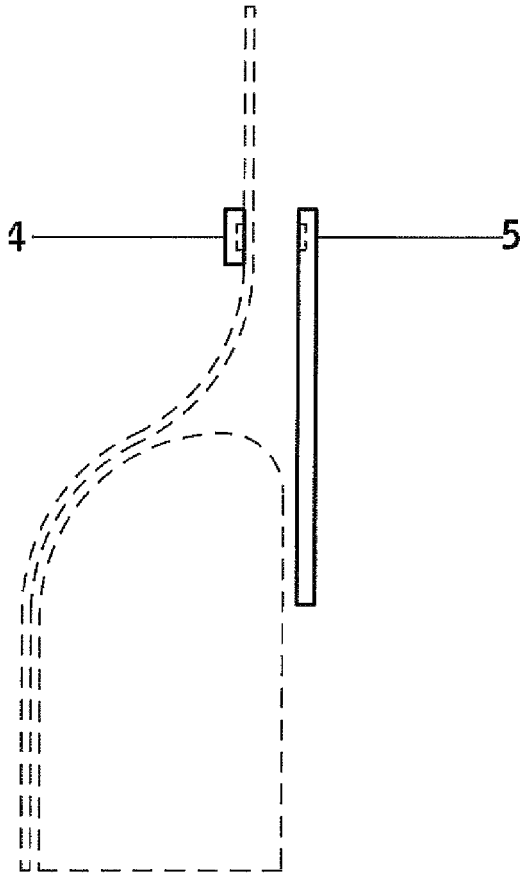
FIG. 7 Side view of an embodiment of the invention.

In another embodiment of the invention, depicted by FIG. 7, one single apparatus 5 optionally replaces the main external unit 1, connector unit 3, and bottom unit 2. In such embodiment, said apparatus may rely on the mass of apparatus 5 drawn against the outside of the water containment vessel, such as the exterior of a bathtub, to counteract the shower curtain effect. Alternative embodiments may, instead or in addition, feature enough weight to pull the barrier or barriers to the outside of the space fully or partially enclosed by the barrier or barriers. In such embodiment, the downward force caused by the weight of the said apparatus pulls downward and/or outward on the barrier or barriers near the upper portion of the said apparatus, where it is affixed to the barrier or barriers. The forces affect the said apparatus and the barrier or barriers simultaneously with another force deriving from the resistance of the exterior edge of rigid body, such as a bathtub, that the lower portion of the said apparatus directly or indirectly comes into contact with. The simultaneous application of forces causes said apparatus and the affixed barrier to counteract the shower curtain effect, in such embodiment as described in this paragraph.

In an embodiment of the invention, a pusher arm may be included, which addresses scenarios where an interior barrier and exterior barrier work in tandem to separate an enclosed space from the exterior of the enclosed space. One example of such a scenario is the situation where both an exterior shower curtain and interior shower curtain liner both hang from the same shower curtain rod. Certain embodiments of the invention comprise a "pusher arm," which guides a barrier inward toward an enclosed space. In such embodiment, when applied to a shower curtain liner, the pusher arm maintains contact with the exterior of the shower curtain liner to ensure that the interior of the shower curtain liner stays within the internal space of the showering area.

In other embodiments of the invention, either the external unit 1 or the internal unit 4 may be excluded from the apparatus. In such embodiment, either the external unit 1 or the internal unit 4 directly affixes to the barrier. In such embodiments, the affixation may take place utilizing, for example only, Velcro, snaps, a form of glue adhesive, a connector pin, or another mechanism, such as those known to those skilled in the art. In certain embodiments of the invention where exterior unit 1 is the only mechanism of attachment to the barrier, the bottom unit 2 and connector unit 3 attach to the external unit 1 on the outside of the barrier. In such embodiment, the bottom unit 2 rests on the external edge of a rigid body near the bottom of the barrier, such as for example only, a bathtub, trapping the barrier between it and the rigid body.

Figure 8:
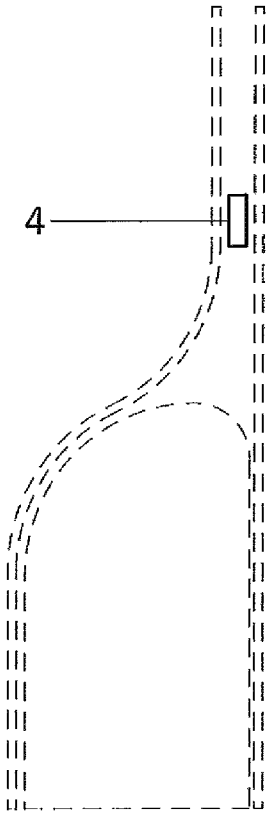
FIG. 8 Side view of an embodiment of the invention.
Figure 9:
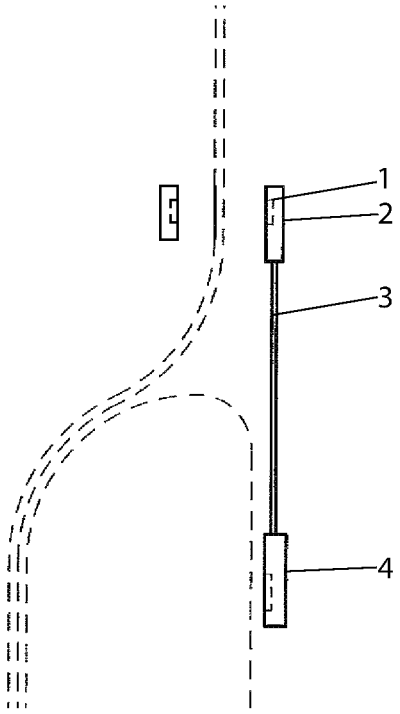
FIG. 9 Side view of an embodiment of the invention.
Figure 10:
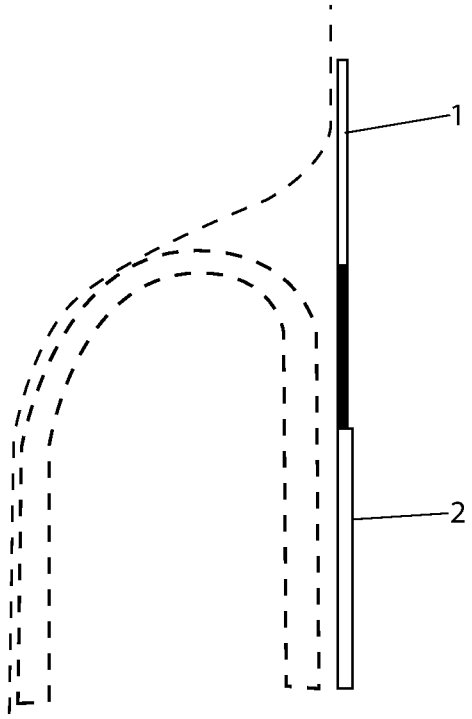
FIG. 10 Side view of an embodiment of the invention.

In another embodiment of the invention, depicted by FIG. 8, an external barrier, such as a shower curtain, replaces the external unit 1, connector unit 3, and bottom unit 2. In such embodiment, the internal unit 4 is replaced by an apparatus that affixes simultaneously to the exterior side of an interior barrier, such as a shower curtain liner, and the interior side of an exterior barrier, such as a shower curtain.

Certain embodiments of the present invention create a full or partial seal between the barrier and the water containment mechanism typically near the bottom of the barrier. In a particular version of certain embodiments, the full or partial seal is formed at the point of contact between a shower curtain and the highest point of a bathtub. Said seal may fully or partially trap water and/or heat within the interior area of a shower or bathtub. Further, in such embodiment said seal may fully or partially prevent water from splashing out of the bathtub.

Certain embodiments of the invention may modify the essence of the invention to accommodate different usages. For example, a travel version incorporates a scaled down internal unit 4, external unit 1, connector unit 3 and bottom unit 2, intended to provide similar functionality but to also be more conveniently packaged for travel. Another embodiment may instead be designed for heavy use in commercial or industrial settings. This embodiment uses more powerful magnets, more durable construction materials, such as thicker plastic, stronger assembly, such as heavier grade screws, and incorporate an antibiotic, such as Microban or other agent, into construction materials to prevent microbial contamination from heavy usage, and from increased frequency of contact with potential sources of bacterial contamination. In certain embodiments, a plurality of internal units 4, external units 1, connector units 3, apparatus 5 or bottom units 2 may be used.

What is claimed is:

1. A shower curtain containment apparatus for a water containment vessel, the shower curtain containment apparatus comprising:
- a shower curtain;
- wherein the shower curtain comprises:
  - a connector unit; and
  - a bottom unit;
    - wherein the connector unit and the bottom unit are integrated into the shower curtain;
    - wherein a weight of the bottom unit is greater than a weight of the connector unit;
    - wherein the connector unit contiguously extends from a point in the shower curtain to the bottom unit and comprises one of a rod, a string, a strap, a cord, a cable, a chain, or a rubber band;
    - wherein the point is placed above a rim of the water containment vessel and the bottom unit is placed below the rim, when the shower curtain is installed over the water containment vessel; and
    - wherein integration of the connector unit and the bottom unit into the shower curtain and the weight of the bottom unit guide the shower curtain away from a shower area; and
- further comprising as part of the connector unit:
- an external unit; and
- an internal unit;
  - wherein the external unit is integrated within the connector unit;
  - wherein the internal unit is selectively attached to an inside portion of the shower curtain;
  - wherein the external unit couples with the internal unit integrate the connector unit into the shower curtain; and
  - wherein the coupling between the external unit and the internal unit is detachable.

2. The shower curtain containment apparatus of claim 1, wherein the connector unit and the bottom unit are integrated during fabrication of the shower curtain.

3. A shower curtain containment apparatus for a water containment vessel, the shower curtain containment comprising:
- a shower curtain; and
- an elongated apparatus;
  - wherein an upper portion of the elongated apparatus is attached to the shower curtain at a point located above a rim of the water containment vessel and a lower portion of the elongated apparatus encloses a weight;
  - wherein the elongated apparatus extends beyond the rim substantially perpendicular to an exterior edge of the water containment vessel;
  - wherein a downward force created by the weight enclosed within the elongated apparatus pulls the shower curtain outwards at the point of attachment of the upper portion;
  - wherein a resistive force created as a result of a contact established between a lower portion of the elongated apparatus and the exterior edge of the water containment vessel resists upward movement of the elongated apparatus; and
  - wherein simultaneous action of the downward force and the resistive force guide the shower curtain away from a shower area;
- and further comprising:
- an external unit; and
- an internal unit;
  - wherein the external unit is integrated within the upper portion of the elongated apparatus;
  - wherein the internal unit is selectively attached to an inside portion of the shower curtain;
  - wherein the external unit couples with the internal unit to attach the elongated apparatus to the shower curtain; and
  - wherein the coupling between the external unit and the internal unit is detachable.

4. The shower curtain containment apparatus of claim 3, wherein the elongated apparatus comprises a weighted object.

5. The shower curtain containment apparatus of claim 4, wherein the weighted object is a rod or a bar.

6. A shower curtain containment apparatus for a water containment vessel, the shower curtain containment apparatus comprising:
- a shower curtain; and
- an elongated apparatus;
  - wherein an upper portion of the elongated apparatus is attached to the shower curtain at a point located above a rim of the water containment vessel;

wherein the elongated apparatus extends beyond the rim substantially perpendicular to an exterior edge of the water containment vessel;

wherein at least a part of a lower portion of the elongated apparatus extending beyond the rim encloses a weighted object;

wherein a downward force created by weight of the weighted object pulls the shower curtain outwards at the point of attachment of the upper portion;

wherein a resistive force created as a result of a contact established between the lower portion of the elongated apparatus and the exterior edge of the water containment vessel resists upward movement of the elongated apparatus; and wherein simultaneous action of the downward force and the resistive force guide the shower curtain away from a shower area;

and further comprising:

an external unit; and an internal unit;

wherein the external unit is integrated within the upper portion of the elongated apparatus;

wherein the internal unit is selectively attached to an inside portion of the shower curtain;

wherein the external unit couples with the internal unit to attach the elongated apparatus to the shower curtain; and wherein the coupling between the external unit and the internal unit is detachable.

7. The shower curtain containment apparatus of claim 6, wherein the weighted object is a rod or a bar.

8. The shower curtain containment apparatus of claim 6, wherein the elongated apparatus is a plastic strip.

* * * * *